US009122204B2

(12) United States Patent
Juri et al.

(10) Patent No.: US 9,122,204 B2
(45) Date of Patent: Sep. 1, 2015

(54) DEVELOPING DEVICE, PROCESS CARTRIDGE, IMAGE FORMING APPARATUS, AND IMAGE FORMING METHOD

(71) Applicants: Keiichiro Juri, Kanagawa (JP); Hideaki Yasunaga, Tokyo (JP)

(72) Inventors: Keiichiro Juri, Kanagawa (JP); Hideaki Yasunaga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/474,870

(22) Filed: Sep. 2, 2014

(65) Prior Publication Data

US 2015/0078777 A1 Mar. 19, 2015

(30) Foreign Application Priority Data

Sep. 17, 2013 (JP) ..... 2013-191499

(51) Int. Cl.
*G03G 15/08* (2006.01)

(52) U.S. Cl.
CPC ..... *G03G 15/0881* (2013.01); *G03G 2221/183* (2013.01)

(58) Field of Classification Search
USPC ..... 399/91, 98, 99, 102, 103, 107, 110, 399/111, 119, 120, 265, 279, 281, 286; 492/48, 53, 56
See application file for complete search history.

(56) References Cited

U.S. PATENT DOCUMENTS 5,842,092 A * 11/1998 Jyoroku ..... 399/262
2006/0204882 A1 9/2006 Nozaki et al.
2006/0275686 A1 12/2006 Kadota et al.
2007/0059625 A1 3/2007 Yamamoto et al.
2007/0122729 A1 5/2007 Katoh et al.
2007/0148568 A1 6/2007 Kadota et al.
2007/0190443 A1 8/2007 Hagi et al.
2007/0207399 A1 9/2007 Kadota et al.
2007/0212630 A1 9/2007 Yasunaga et al.
2007/0217842 A1 9/2007 Kato et al.
2007/0238042 A1 10/2007 Yasunaga et al.
2008/0038656 A1 2/2008 Yasunaga et al.
2008/0063957 A1 3/2008 Murakami et al.
2008/0069598 A1 3/2008 Murakami et al.
2008/0069605 A1 3/2008 Fuwa et al.
2008/0069608 A1 3/2008 Katoh et al.
2008/0070149 A1 3/2008 Kato et al.
2008/0153018 A1 6/2008 Mikuriya et al.
2008/0159777 A1 7/2008 Fuwa et al.
2008/0175630 A1 7/2008 Yasunaga et al.

(Continued)

FOREIGN PATENT DOCUMENTS

JP 11-295987 10/1999
JP 2003-029527 1/2003

(Continued)

*Primary Examiner* — Hoan Tran
(74) *Attorney, Agent, or Firm* — Oblon, McClelland, Maier & Neustadt, L.L.P.

(57) ABSTRACT

A developing device includes a developing roller including a base and a surface layer formed on the base, the surface layer including a polyurethane resin having a fluorine group and a polyfunctional isocyanurate structure, a toner storage chamber being partially in contact with the developing roller and to support the developing roller, and a sealing member provided at opposed ends of an end portion of the toner storage chamber in a rotating axis direction of the developing roller, and to seal in toner moving to the end portion of the toner storage chamber, the sealing member before use having a coefficient of static friction in a range of from 0.08 to 0.19.

7 Claims, 3 Drawing Sheets

(56) References Cited

U.S. PATENT DOCUMENTS

| | | | |
|---|---|---|---|
| 2008/0199234 | A1 | 8/2008 | Hagi et al. |
| 2008/0226356 | A1 | 9/2008 | Yasunaga et al. |
| 2008/0227009 | A1 | 9/2008 | Fuwa et al. |
| 2008/0233506 | A1 | 9/2008 | Hagi et al. |
| 2008/0279591 | A1 | 11/2008 | Yasunaga et al. |
| 2008/0304875 | A1 | 12/2008 | Katoh et al. |
| 2009/0041511 | A1 | 2/2009 | Fuwa et al. |
| 2009/0052952 | A1 | 2/2009 | Katoh et al. |
| 2009/0117481 | A1 | 5/2009 | Yasunaga et al. |
| 2009/0169270 | A1 | 7/2009 | Fuwa et al. |
| 2009/0186291 | A1 | 7/2009 | Mikuriya et al. |
| 2010/0009282 | A1 | 1/2010 | Katoh et al. |
| 2010/0167196 | A1 | 7/2010 | Hagi et al. |
| 2011/0243616 | A1 | 10/2011 | Nakagawa et al. |
| 2012/0237270 | A1 | 9/2012 | Juri et al. |
| 2013/0058685 | A1 | 3/2013 | Juri et al. |

FOREIGN PATENT DOCUMENTS

| | | |
|---|---|---|
| JP | 2004-198710 | 7/2004 |
| JP | 2009-003308 | 1/2009 |
| JP | 2009-110023 | 5/2009 |
| JP | 2011-215467 | 10/2011 |
| JP | 2012-212117 | 11/2012 |

* cited by examiner

DEVELOPING DEVICE, PROCESS CARTRIDGE, IMAGE FORMING APPARATUS, AND IMAGE FORMING METHOD

CROSS-REFERENCE TO RELATED APPLICATIONS

This patent application is based on and claims priority pursuant to 35 U.S.C. §119 from Japanese Patent Application No. 2013-191499, filed on Sep. 17, 2013 in the Japan Patent Office, which is hereby incorporated by reference herein in its entirety.

BACKGROUND

1. Technical Field

Exemplary embodiments of the present disclosure generally relate to a developing device, a process cartridge employing the developing device, an image forming apparatus employing the developing device, and an image forming method.

2. Description of the Related Art

In image forming apparatuses employing a single-component contact-type development method, a method of preventing toner leakage at an end portion of a rotationally driven developing roller by providing a sealing member at the end portion of the developing roller and pressing the sealing member against the developing roller with a constant pressure is known.

However, in the conventional technology, there are problems of fusing of toner or wear of the developing roller, due to frictional heat generated by sliding abrasion between the end portion of the developing roller and the sealing member, which may further result in a problem of spilling of toner. The above-described problems become significant for the image forming apparatuses employing spherical polymerized toner having good low-temperature fixability, or image forming apparatuses adapted to high speeds and long operating lives.

SUMMARY

In view of the foregoing, in an aspect of this disclosure, there is provided a novel developing device including a developing roller including a base and a surface layer formed on the base, the surface layer including a polyurethane resin having a fluorine group and a polyfunctional isocyanurate structure, a toner storage chamber being partially in contact with the developing roller and to support the developing roller, and a sealing member provided at opposed ends of an end portion of the toner storage chamber in a rotating axis direction of the developing roller, and to seal in toner moving to the end portion of the toner storage chamber, the sealing member before use having a coefficient of static friction in a range of from 0.08 to 0.19.

These and other aspects, features, and advantages will be more fully apparent from the following detailed description of illustrative embodiments, the accompanying drawings, and associated claims.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1A:
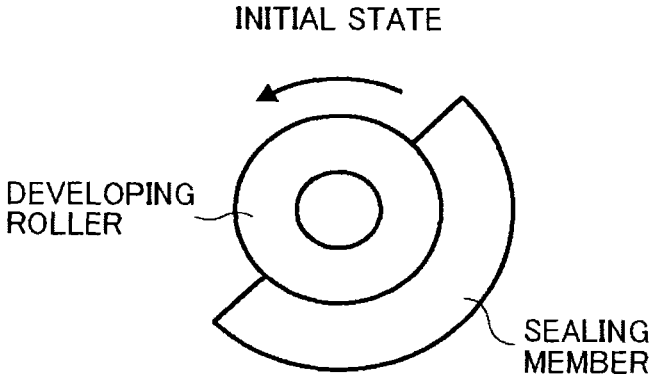
FIG. 1A is a schematic view showing a relation between a surface layer of a developing roller and an end portion of a sealing member, and shows a state of initial rotation of the developing roller.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

Hereinafter, exemplary embodiments of the present invention are described in detail with reference to the drawings. However, the present invention is not limited to the exemplary embodiments described below, but may be modified and improved within the scope of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

There is provided a novel developing device in which fusing of toner and wear of a developing roller is suppressed with an uncomplicated structure of the developing roller and a sealing member. As a result, spilling of toner is not generated even with image forming apparatuses employing spherical polymerized toner having good low-temperature fixability.

Figure 1B:
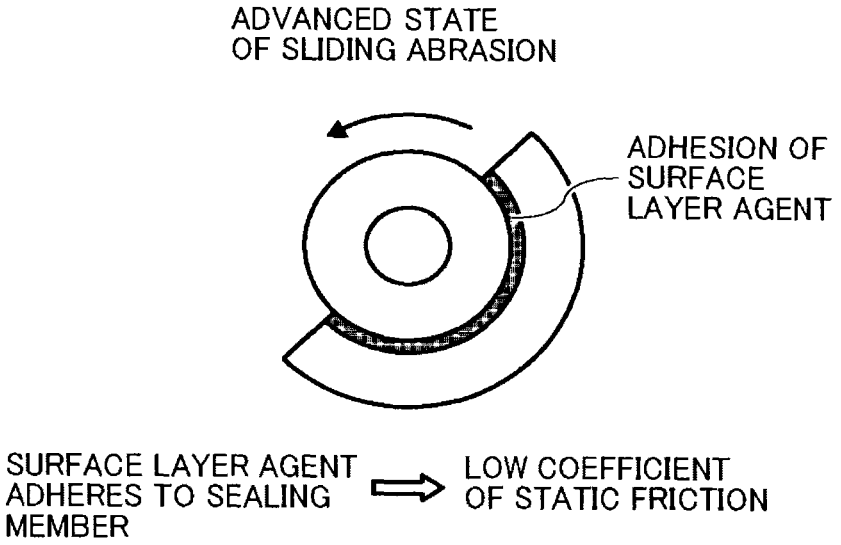
FIG. 1B is a schematic view showing a relation between a surface layer of a developing roller and an end portion of a sealing member, and shows an advanced state of sliding abrasion between the surface layer of the developing roller and the sealing member over a long period of rotation of the developing roller.

Referring now to FIG. 1A and FIG. 1B, an embodiment of the present invention is described in detail below.

FIG. 1A and FIG. 1B are schematic views showing a relation between a surface layer of a developing roller and an end portion of a sealing member. FIG. 1A shows a state of initial rotation of the developing roller. FIG. 1B shows an advanced state of sliding abrasion between the surface layer of the developing roller and the sealing member over a long period of rotation of the developing roller.

As shown in FIG. 1A, adhesion of a surface layer agent included in the surface layer of the developing roller to the sealing member at initial rotation does not exist. However, over time, a portion of the surface layer agent adheres to the sealing member due to sliding abrasion between the surface layer of the developing roller and the sealing member. The surface layer agent has a low coefficient of static friction (μ). Accordingly, at a sliding abrasion portion, due to the surface layer agent of the developing roller adhering to the sealing member sliding against the surface layer of the developing roller, a coefficient of static friction of the sealing member declines in comparison to before the advanced state of sliding abrasion. Thus, excessive rise of friction energy may be suppressed.

In the embodiment of the present invention, as described above, excessive rise of friction energy is suppressed by including a polyurethane resin having a fluorine group and a polyfunctional isocyanurate structure as the surface layer agent having a low coefficient of static friction (μ) in the surface layer of the developing roller. Accordingly, a developing device in which fusing of toner and wear of the developing roller is suppressed with an uncomplicated structure of the developing roller and the sealing member is obtained. As a result, spilling of toner is not generated even in high-speed and long-operating image forming apparatus employing spherical polymerized toner having good low-temperature fixability.

Specific examples of the polyurethane resin having the fluorine group and the polyfunctional isocyanurate structure included in the surface layer of the developing roller include, but are not limited to, a reaction product of a tolylene diisocyanate isocyanurate and a copolymer of fluoroolefin having a hydroxyl group, and a reaction product of an isophorone diisocyanate isocyanurate and a copolymer of tetrafluoroethylene and vinyl monomer.

Preferably, the polyurethane resin is a reaction product of a hexamethylene diisocyanate isocyanurate and an alternating copolymer of fluoroethylene and vinyl ether.

It is preferable that an outermost surface of the sealing member includes a fibrous nap, a film, a felt material, or a base fabric. Preferable materials forming the outermost surface of the sealing member include, but are not limited to, a fluorine resin, polyester, an acrylic resin, ultra high molecular weight polyethylene, polyamide, and polypropylene. It is to be noted that ultra high molecular weight polyethylene is widely known and is polyethylene having a molecular weight in a range of from 1,000,000 to 7,000,000.

A coefficient of static friction of the sealing member before use is in a range of from 0.08 to 0.19. When the coefficient of static friction of the sealing member is less than 0.08, friction caused by sliding abrasion with the developing roller is reduced. However, performance of sealing toner between the developing roller and the sealing member declines and toner may leak. By contrast, when the coefficient of static friction of the sealing member exceeds 0.19, friction energy due to sliding abrasion of the developing roller and the sealing member is too large and wear of the developing roller progresses.

Preferably, a coefficient of static friction of the developing roller before use is in a range of from 0.11 to 0.13. When the coefficient of static friction of the developing roller is less than 0.11, friction is suppressed at the end portion. In terms of sliding abrasion of the developing roller and the sealing member, suppressing friction at the end portion is preferable. However, toner conveyance performance at an image area portion may become poor. By contrast, when the coefficient of static friction of the developing roller exceeds 0.13, wear of the developing roller may progress. Preferably, a difference of the coefficient of static friction of the developing roller and the sealing member before use is in a range of from 0.01 to 0.07.

In addition, a coefficient of static friction of the developing roller after use is preferably in a range of from 0.98 to 1.03, a coefficient of static friction of the sealing member after use is preferably in a range of from 0.07 to 0.16, and a difference of the coefficient of static friction of the developing roller and the sealing member after use is preferably in a range of from 0.82 to 0.98. It is to be noted that "after use" is defined as a state after printing around 2000 sheets or more of a predetermined image pattern under a high temperature and high humidity (HH) environment of a temperature of 27° C. and a relative humidity of 80%.

When the coefficient of static friction of the developing roller after use is less than 0.98, performance of sealing toner between the developing roller and the sealing member declines and toner may leak. By contrast, when the coefficient of static friction of the developing roller exceeds 1.03, sliding abrasion energy is too high and toner may fuse to the end portion. When the coefficient of static friction of the sealing member after use is less than 0.07, performance of sealing toner between the developing roller and the sealing member may decline. When the coefficient of static friction of the sealing member after use exceeds 0.16, wear of the developing roller may progress.

Figure 2:
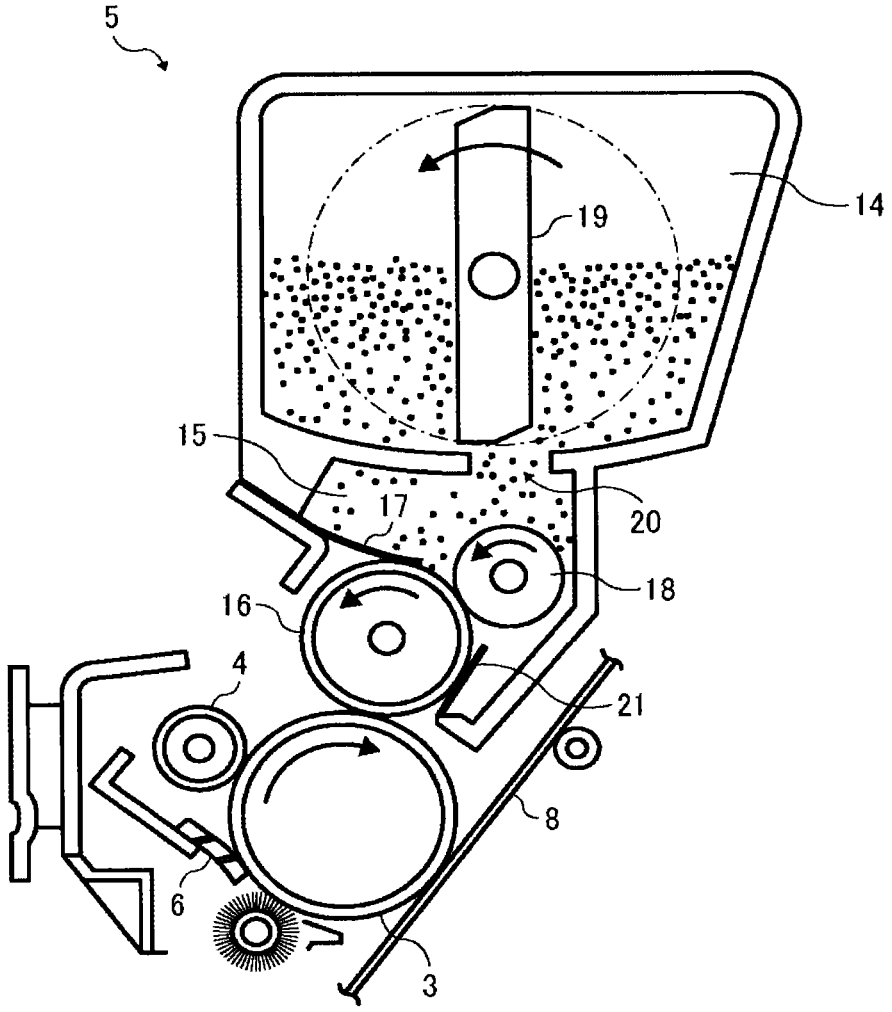
FIG. 2 is a sectional view of an example of a developing device according to an embodiment of the present invention.

FIG. 2 is a sectional view of an example of a developing device 5 according to an embodiment of the present invention. A developing roller 16 shown in FIG. 2 has the structure of a developing roller according to an embodiment of the present invention.

As shown in FIG. 2, a toner agitation member 19 that makes toner stored in a toner storage chamber 14 flow by rotating in a counter-clockwise direction is provided in the toner storage chamber 14. Toner that is flowing due to the toner agitation member 19 passes through an opening 20 provided directly above a supply roller 18 and drops into a toner supply chamber 15. A configuration in which the opening 20 is only provided directly above the supply roller 18 is employed. A partition separating the toner storage chamber 14 and the toner supply chamber 15 is provided directly above a blade 17.

A surface of the supply roller 18 is coated with a porous foaming material having a structure including pores (i.e., cells). With such a structure, toner conveyed to the toner supply chamber 15 efficiently adheres to the surface of the supply roller 18 and degradation of toner caused by concentration of pressure at a contact portion of the supply roller 18 and the developing roller 16 is prevented. A conductive material including fine carbon particles is employed as the foaming material. Electrical resistance of the conductive material including fine carbon particles is set to a range of from $10^3\Omega$ to $10^{13}\Omega$. A supply bias of the same polarity as a charging polarity of toner with an offset value with respect to a developing bias is applied to the supply roller 18. The supply bias presses pre-charged toner in the direction of the developing roller 16 at the contact portion of the supply roller 18 and the developing roller 16. The supply roller 18 is rotationally driven in a counter-clockwise direction by a rotation drive mechanism, not shown in FIG. 2, and supplies toner adhering to the surface of the supply roller 18 to a surface of the developing roller 16 to coat the surface.

The developing roller 16 is rotationally driven in a counter-clockwise direction by a rotation drive mechanism not shown in FIG. 2. Accordingly, toner on the surface of the developing roller 16 is conveyed to the blade 17 and to a position opposite a photoreceptor 3.

The blade 17 is configured of a plate spring formed of a metal such as SUS304 CSP, SUS301 CSP, and phosphor bronze. A base end of the blade 17 is fixed to a member configuring the toner storage chamber 14. A free end of the blade 17 is contacted to and pressed against the surface of the developing roller 16 at a pressing force in a range of from 10 N/m to 100 N/m. Toner that has passed the blade 17 is formed into a thin layer by the pressing force and an electric charge is imparted by frictional electrification. In order to assist frictional electrification of toner, a regulation bias of the same polarity as a charging polarity of toner with an offset value with respect to the developing bias is applied to the blade 17.

In the above-described example of the developing device 5, the photoreceptor 3 rotates in a clockwise direction and the surface of the developing roller 16 moves in the same direction as the photoreceptor 3 at a position opposite the photoreceptor 3. Toner that has been made into a thin layer by the blade 17 is conveyed to the position opposite the photoreceptor 3 by rotation of the developing roller 16. Then, toner moves to a surface of the photoreceptor 3 according to an electrostatic latent image electric field formed by an electrostatic latent image on the photoreceptor 3 due to the developing bias applied to the developing roller 16. Accordingly, the electrostatic latent image is made visible. A seal 21 that prevents toner from leaking out of the developing device 5 is provided contacting the developing roller 16 at a portion in which toner that did not move to the surface of the photoreceptor 3 but remains on the surface of the developing roller 16 returns to the toner supply chamber 15.

With the above-described configuration, the following effect is obtained. Due to providing the opening 20 in which the developer is dropped from the toner storage chamber 14 to the toner supply chamber 15 directly above the supply roller 18 and in a position other than directly above the blade 17, a flow route leading to the supply roller 18 of the developer is secured and conveyance of a sufficient amount of the developer with respect to the toner supply chamber 15 is obtained. In addition, particle pressure due to a weight of the developer within the toner storage chamber 14 does not extend to around the blade 17. Accordingly, movement of the developer around the blade 17 that is not made into a thin layer by the blade 17 is smooth and the developer spreads throughout the whole toner supply chamber 15.

Figure 3:
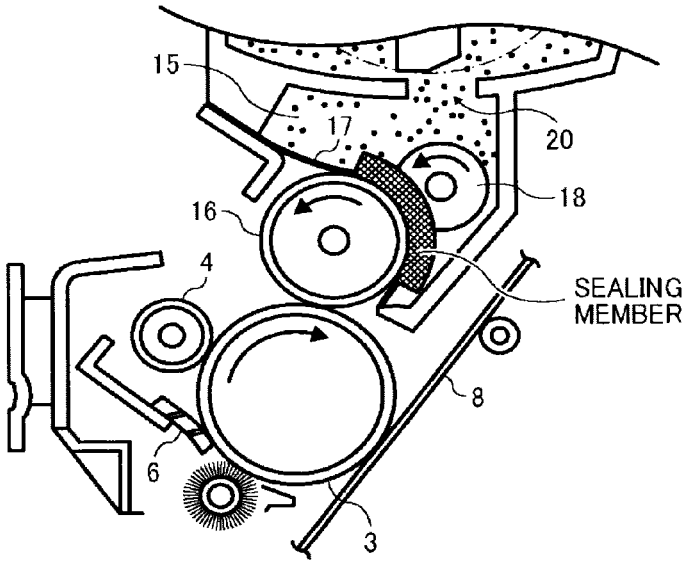
FIG. 3 is a sectional view of an end portion of the developing device of FIG. 2.

FIG. 3 is a sectional view of an end portion of the developing device of FIG. 2. A sealing member according to an embodiment of the present invention having the above-defined features is employed as the sealing member shown in FIG. 3.

A process cartridge in which the above-described developing device 5 and the above-described photoreceptor 3 are configured as a single unit may be manufactured. Preferably, the process cartridge has a structure in which the process cartridge may be detachably attached to an image forming apparatus described below.

Figure 4:
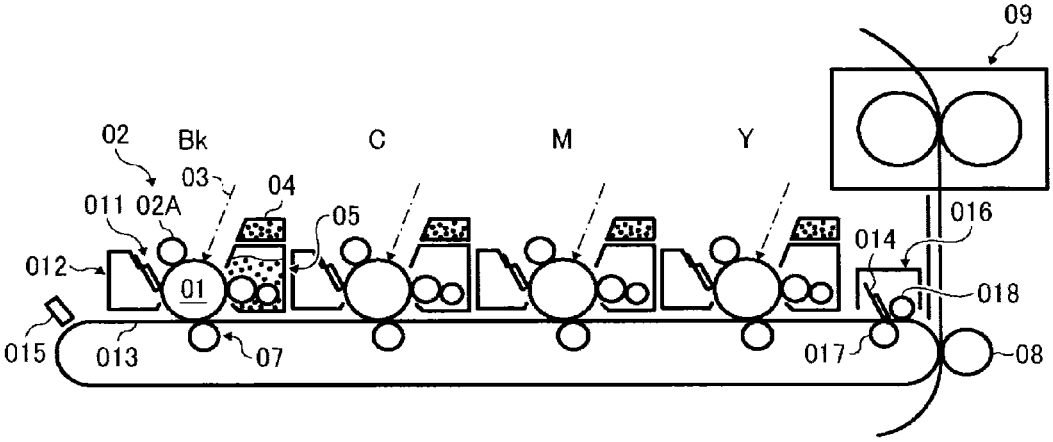
FIG. 4 is a schematic view of an example of a tandem-type image forming apparatus.

FIG. 4 is a schematic view of an example of a tandem-type image forming apparatus.

Provided around a photoreceptor drum 01 serving as an image carrier, sequentially, is a charging device 02 to charge a surface of the photoreceptor drum 01, an exposure mechanism 03 that emits a laser beam to form an electrostatic latent image on the uniformly charged surface of the photoreceptor drum 01, a developing device 05 to form a toner image by attaching charged toner to the electrostatic latent image formed on the surface of the photoreceptor drum 01 by the laser beam, a transfer device 07 to transfer the toner image formed on the surface of the photoreceptor drum 01 to a transfer body, and a cleaning device 012 to remove residual toner remaining on the surface of the photoreceptor drum 01 after development. Further, a toner supply container 04 to supply toner to the developing device 05 is provided above the developing device 05. The toner supply container 04 stores toner that may be exchanged and is connected to the developing device 05. The toner supply container 04 shown in FIG. 4 has a configuration in which toner is conveyed directly to a storage of the developing device 05. However, alternatively a supply route may be provided within the image forming apparatus itself and toner is supplied to the storage of the developing device 05 via the supply route.

In electrophotography of the tandem-type image forming apparatus, an image of a single color such as black (Bk), cyan (C), magenta (M), and yellow (Y) is formed on a surface of a photoreceptor drum corresponding to the single color. In a case of employing an negative-positive method (i.e., a method in which the electric potential of an exposure area irradiated by the laser beam is lowered and toner is attached) to form images with the above-described configuration, the surface of the photoreceptor drum 01 is uniformly charged to a negative polarity with a charging roller 02A of the charging device 02, an electrostatic latent image is formed on the surface of the photoreceptor drum 01 with the exposure mechanism 03, and toner is attached to the surface of the photoreceptor drum 01 with the developing device 05. Accordingly, the electrostatic latent image is made visible as a toner image. The toner image is transferred from the surface of the photoreceptor drum 01 to a surface of an intermediate transfer belt 013 constituting the transfer device 07. Residual toner that did not transfer from the surface of the photoreceptor drum 01 to the surface of the intermediate transfer belt 013 is removed from the surface of the photoreceptor drum 01 by a first cleaning blade 011 of the cleaning device 012. A bias is applied to a secondary transfer roller 08 at a secondary transfer portion and the toner image transferred to surface of the intermediate transfer belt 013 is transferred to a recording sheet conveyed from a sheet feed tray. After transfer of the toner image to the recording sheet, residual toner or other external materials on the surface of the intermediate transfer belt 013 is removed with a cleaning unit 016.

The toner image transferred to the recording sheet is melted and fixed onto the recording sheet with a fixing device 09, and ejected via a sheet ejection opening not shown in FIG. 4. A sensor 015 shown in FIG. 4 is employed for adjusting image density or image position alignment by measuring the amount of toner transferred to the surface of the intermediate transfer belt 013 and the position of each color image. The sensor 015 employs a combination of regular reflection and diffuse reflection methods. The cleaning unit 016 shown in FIG. 4 cleans residual toner from the surface of the intermediate transfer belt 013. A second cleaning blade 014 of the cleaning unit 016 contacts the surface of the intermediate transfer belt 013 in a direction counter to a moving direction of the surface of the intermediate transfer belt 013. A metal opposed roller 017 is provided opposite the second cleaning blade 014 of the cleaning unit 016. Residual toner removed by the second cleaning blade 014 of the cleaning unit 016 is conveyed by a coil 018 to a waste toner storage member not shown in FIG. 4 and stored.

EXAMPLES

Further understanding can be obtained by reference to specific examples, which are provided hereinafter. However, it is to be understood that the embodiments of the present invention are not limited to the following examples.

Manufacture of Developing Roller

A developing roller of each pattern 1 to pattern 6 is manufactured as follows.

Pattern 1

Formation of Conductive Elastic Layer

Epichlorohydrin rubber Hydrin T3106 (from Zeon Corporation) is coated on a surface of a roller base (ϕ 6 metal shaft) and a conductive elastic layer having a film thickness of 3 mm is formed. Rough grinding and finish polishing is conducted on the surface of the conductive elastic layer with a grinding machine LEO-600-F4L-BME (from Minakuchi Machinery Works Ltd.) for a rubber roller. Then, the surface of the conductive elastic layer is further polished with a grinding machine SZC (from Minakuchi Machinery Works Ltd.).

Formation of Surface Layer (Toner Carrying Layer)

A surface layer coating liquid is prepared by mixing coating liquid materials described below and adding 0.1 parts of a catalyst Neostann U-820 (from Nitto Kasei Co., Ltd.).

The surface layer coating liquid is spray coated on the conductive elastic layer of the roller base, and heat cured by annealing for 0.5 hours at 130° C. and for 1 hour at 145° C. A developing roller of pattern 1 is obtained.

Surface Layer Coating Liquid Materials of Pattern 1

Hexamethylene diisocyanate isocyanurate D170N (from Mitsui Chemicals, Inc.) . . . 1 part
Fluorine based polyol: Lumiflon LF200MEK (from Asahi Glass Co., Ltd.) . . . 0.099 parts
Carbon black (from Fuji Pigment Co., Ltd.) . . . 0.22 parts
Butyl acetate . . . 1 part
Ethyl acetate . . . 9 parts Pattern 2

Formation of Conductive Elastic Layer

Epichlorohydrin rubber Hydrin T3106 (from Zeon Corporation) is coated on a surface of a roller base (ϕ 6 metal shaft) and a conductive elastic layer having a film thickness of 3 mm is formed. Rough grinding and finish polishing is conducted on the surface of the conductive elastic layer with a grinding machine LEO-600-F4L-BME (from Minakuchi Machinery Works Ltd.) for a rubber roller.

Formation of Surface Layer (Toner Carrying Layer)

A surface layer coating liquid is prepared by mixing coating liquid materials described below and adding 0.1 parts of a catalyst Neostann U-820 (from Nitto Kasei Co., Ltd.).

The surface layer coating liquid is spray coated on the conductive elastic layer of the roller base, and heat cured by annealing for 0.5 hours at 130° C. and for 1 hour at 145° C. A developing roller of pattern 2 is obtained.

Surface Layer Coating Liquid Materials of Pattern 2

Hexamethylene diisocyanate isocyanurate D170N (from Mitsui Chemicals, Inc.) . . . 1 part
Fluorine based polyol: Lumiflon LF200MEK (from Asahi Glass Co., Ltd.) . . . 0.110 parts
Carbon black (from Fuji Pigment Co., Ltd.) . . . 0.06 parts
Silica fine particles: H20TM (from Nippon Aerosil Co., Ltd.) . . . 0.022 parts
Butyl acetate . . . 1 part
Ethyl acetate . . . 9 parts Pattern 3

Formation of Surface Layer (Toner Carrying Layer)

A surface layer coating liquid is prepared by mixing coating liquid materials described below and adding 0.1 parts of a catalyst Neostann U-820 (from Nitto Kasei Co., Ltd.).

The surface layer coating liquid is spray coated on the conductive elastic layer of a roller base as described in pattern 1, and heat cured by annealing for 0.5 hours at 130° C. and for 1 hour at 145° C. A developing roller of pattern 3 is obtained.

Surface Layer Coating Liquid Materials of Pattern 3

Hexamethylene diisocyanate isocyanurate D170N (from Mitsui Chemicals, Inc.) . . . 1 part
Fluorine based polyol: Lumiflon LF200MEK (from Asahi Glass Co., Ltd.) . . . 0.086 parts
Carbon black (from Fuji Pigment Co., Ltd.) . . . 0.32 parts
Silica fine particles: H20TM (from Nippon Aerosil Co., Ltd.) . . . 0.016 parts
Butyl acetate . . . 1 part
Ethyl acetate . . . 9 parts Pattern 4

Formation of Conductive Elastic Layer

Epichlorohydrin rubber Hydrin T3106 (from Zeon Corporation) is coated on a surface of a roller base (ϕ 6 metal shaft) and a conductive elastic layer having a film thickness of 3 mm is formed. Rough grinding and finish polishing is conducted on the surface of the conductive elastic layer with a grinding machine LEO-600-F4L-BME (from Minakuchi Machinery Works Ltd.) for a rubber roller.

Formation of Surface Layer (Toner Carrying Layer)

A surface layer coating liquid is prepared by mixing coating liquid materials described below and adding 0.1 parts of a catalyst Neostann U-820 (from Nitto Kasei Co., Ltd.).

The surface layer coating liquid is spray coated on the conductive elastic layer of the roller base, and heat cured by annealing for 0.5 hours at 130° C. and for 1 hour at 145° C. A developing roller of pattern 4 is obtained.

Surface Layer Coating Liquid Materials of Pattern 4

Hexamethylene diisocyanate isocyanurate D170N (from Mitsui Chemicals, Inc.) . . . 1 part
Fluorine based polyol: Lumiflon LF200MEK (from Asahi Glass Co., Ltd.) . . . 0.164 parts
Carbon black (from Fuji Pigment Co., Ltd.) . . . 0.28 parts
Butyl acetate . . . 1 part
Ethyl acetate . . . 9 parts Pattern 5

Formation of Surface Layer (Toner Carrying Layer)

A surface layer coating liquid is prepared by mixing coating liquid materials described below and adding 0.1 parts of a catalyst Neostann U-820 (from Nitto Kasei Co., Ltd.).

The surface layer coating liquid is spray coated on the conductive elastic layer of a roller base as described in pattern 1, and heat cured by annealing for 0.5 hours at 130° C. and for 1 hour at 145° C. A developing roller of pattern 5 is obtained.

Surface Layer Coating Liquid Materials of Pattern 5 hexamethylene diisocyanate adduct D160N (from Mitsui Chemicals, Inc.) . . . 1 part
Fluorine based polyol: Lumiflon LF200MEK (from Asahi Glass Co., Ltd.) . . . 0.135 parts
Carbon black (from Fuji Pigment Co., Ltd.) . . . 0.23 parts
Butyl acetate . . . 1 part
Ethyl acetate . . . 9 parts Pattern 6

A developing roller of pattern 6 is made in accordance with example 3 of JP-2011-215467-A.

The developing roller of pattern 6 includes a conductive urethane resin inner layer on a circumference of a shaft body, and a coat layer provided on the surface the conductive urethane resin inner layer.

Manufacture of Sealing Member

A sealing member of each pattern 1 to pattern 11 is manufactured as follows. It is to be noted that each of the sealing members is a typical sealing member generally employed in the technical field described herein.

Pattern 1

A sealing member configured of a teflon (registered trademark) felt (from Nisshinfelt Co., Ltd.) bonded on a soft urethane foam (from Inoac Corporation).

Pattern 2

A sealing member configured of a polyester film (from Mitsubishi Plastics, Inc.) bonded on a polystyrene foam sheet (from JSP).

Pattern 3

A sealing member configured of an acrylic fiber (from Mitsubishi Rayon Co., Ltd.) bonded on an ethylene-propylene-diene copolymer rubber (EPDM) sheet.

Pattern 4

A sealing member configured of a nylon film (from Unitika Ltd.) bonded on a chloroprene rubber (CR) foam sheet (from Inoac Corporation).

Pattern 5

A sealing member configured of a polymethyl methacrylate (PMMA) resin film (from Mitsubishi Rayon Co., Ltd.) bonded on a polyolefin based elastomer foam body sheet (from Daiichi Kagaku Inc.).

Pattern 6

A sealing member configured of an ultra high molecular weight polyethylene fiber (from Toyobo Co., Ltd.) bonded on the sealing member of pattern 2.

Pattern 7

A sealing member configured of a fluorine fiber (from Toray Fine Chemicals Co., Ltd.) bonded on the sealing member of pattern 3.

Pattern 8

A sealing member configured of a polyamide fiber (from Toray Industries, Inc.) bonded on the sealing member of pattern 4.

Pattern 9

A sealing member configured of a polypropylene fiber (from Mitsubishi Rayon Co., Ltd.) bonded on the sealing member of pattern 5.

Pattern 10 (Type in Which a Coefficient of Static Friction is Less Than a Lower Limit Value)

A sealing member configured of a diamond-like carbon (DLC) coated on the sealing member of pattern 2 employing a DLC film formation device (from Nanotec Corporation).

Pattern 11 (Type in Which a Coefficient of Static Friction Exceeds an Upper Limit Value)

A sealing member configured of a low density polyethylene film (from Prime Polymer Co., Ltd.) bonded on a polyolefin based elastomer foam body sheet (from Daiichi Kagaku Inc.).

Examples 1 to 11 and Comparative Examples 1 to 6

A process cartridge of IPSIO SP C310 (from Ricoh Company, Ltd.) is dismantled into a developing side and a photoreceptor side. Then, a developing device is manufactured by exchanging a developing roller and a sealing member set in the developing side with each of the above-described developing rollers of pattern 1 to pattern 6 and each of the above-described sealing members of pattern 1 to pattern 11.

Combination of the above-described developing rollers of pattern 1 to pattern 6 and the above-described sealing members of pattern 1 to pattern 11 for each example and each comparative example is shown in Table 1.

Evaluation of properties of each of the developing rollers of pattern 1 to pattern 6, sealing members of pattern 1 to pattern 11, and developing devices is measured in a manner described below. Results are shown together in Table 1.

Measurement of Coefficient of Static Friction

A method described in paragraph 0082 of JP-2003-029527-A is employed for measurement of coefficient of static friction. However, instead of an overhead projector (OHP) sheet used in JP-2003-029527-A, a copy sheet type 6200 (from Ricoh Company, Ltd.) is used. Measurement of a coefficient of static friction of each of the developing rollers of pattern 1 to pattern 6 and each of the sealing members of pattern 1 to pattern 11 is conducted at a normal temperature and normal humidity (NN) environment of a temperature of 23° C. and a relative humidity of 45%. Each of the developing rollers of pattern 1 to pattern 6 is fixed to a support and measured as is. Each of the sealing members of pattern 1 to pattern 11 is measured in a state of being wrapped around a base drum like a photoreceptor.

Measurement is conducted before use and after use (i.e., a durability test conducted in a measurement test of amount of wear of an end portion described below).

Amount of Wear of End Portion of Developing Roller

Printing of 2000 sheets of a predetermined image pattern of a chart having 1% image area at a HH environment of a temperature of 27° C. and a relative humidity of 80% is conducted using IPSIO SP C310 (from Ricoh Company, Ltd.) employing the combination of the above-described developing rollers of pattern 1 to pattern 6 and the above-described sealing members of pattern 1 to pattern 11 shown in Table 1. After printing, an amount of wear of an end portion of a driving side of each of the developing rollers of pattern 1 to pattern 6 is measured with a measuring projector PJ-H30 (from Mitutoyo Corporation). Evaluation is conducted according to the following evaluation standard.

Evaluation Standard

Excellent: Amount of wear less than 100 μm

Good: Amount of wear 100 μm or more, and less than 250 μm

Poor: Amount of wear 250 μm or more

Measurement of Temperature of End Portion of Developing Roller

Each of the developing rollers of pattern 1 to pattern 6 of a process cartridge of IPSIO SP C310 (from Ricoh Company, Ltd.) is rotated at a linear velocity of 400 mm/s using an external motor. Accordingly, a surface temperature of an end portion of a driving side of each of the developing rollers of pattern 1 to pattern 6 while rotating is measured with an infrared thermometer AD-5614 (from A & D Company, Limited) having a laser marker.

It is to be noted that the surface temperature of the end portion of the driving side of each of the developing rollers of pattern 1 to pattern 6 is a measurement after rotation of each of the developing rollers of pattern 1 to pattern 6 has reached a fixed value from start of rotation and has become stable.

Evaluation Standard

Excellent: Temperature of an end portion is less than 60° C.

Good: Temperature of an end portion is 60° C. or more, and less than 70° C.

Poor: Temperature of an end portion is 70° C. or more

Toner Leakage Due to Insufficient Sealing Strength of Sealing Member

When a coefficient of static friction of a sealing member is too low, toner is ineffectively sealed and toner leakage occurs. The occurrence of toner leakage due to a low coefficient of static friction is different to an occurrence of toner leakage due to wear of an end portion of the developing roller.

Thus, toner leakage is measured as follows and evaluation is conducted according to the following evaluation standard.

Printing of a predetermined image pattern of a chart having 1% image area at a HH environment of a temperature of 27° C. and a relative humidity of 80% is conducted using IPSIO SP C310 (from Ricoh Company, Ltd.) employing the combination of the above-described developing rollers of pattern 1 to pattern 6 and the above-described sealing members of pattern 1 to pattern 11 shown in Table 1. After printing, visual confirmation of occurrence of images due to toner leakage at white portions of a print is conducted. Printing is discontinued at a point in which toner leakage is visually confirmed. In a case in which toner leakage is not visually confirmed, printing is continued up to 5000 sheets.

Evaluation Standard

Good: Toner leakage does not occur even when 5000 sheets are printed

Poor: Toner leakage is visually confirmed

TABLE 1

| | | Developing roller | | | Sealing member | | |
|---|---|---|---|---|---|---|---|
| | | Pattern | Coefficient of static friction (Before use) | Coefficient of static friction (After use) | Pattern | Coefficient of static friction (Before use) | Coefficient of static friction (After use) |
| Examples | 1 | 1 | 0.11 | 1.03 | 1 | 0.08 | 0.07 |
| | 2 | 1 | 0.11 | 1.03 | 4 | 0.16 | 0.14 |
| | 3 | 1 | 0.11 | 1.03 | 8 | 0.15 | 0.12 |
| | 4 | 2 | 0.13 | 0.98 | 2 | 0.11 | 0.08 |
| | 5 | 2 | 0.13 | 0.98 | 3 | 0.18 | 0.15 |
| | 6 | 2 | 0.13 | 0.98 | 6 | 0.14 | 0.10 |
| | 7 | 2 | 0.13 | 0.98 | 9 | 0.19 | 0.16 |
| | 8 | 3 | 0.12 | 1.00 | 5 | 0.15 | 0.13 |
| | 9 | 3 | 0.12 | 1.00 | 7 | 0.10 | 0.09 |
| | 10 | 3 | 0.12 | 1.00 | 9 | 0.19 | 0.14 |
| | 11 | 4 | 0.14 | 1.08 | 1 | 0.08 | 0.06 |
| Comparative examples | 1 | 5 | 0.17 | 1.01 | 1 | 0.08 | 0.20 |
| | 2 | 5 | 0.17 | 1.01 | 8 | 0.15 | 0.27 |
| | 3 | 6 | 0.27 | 0.99 | 3 | 0.18 | 0.30 |
| | 4 | 6 | 0.27 | 0.99 | 6 | 0.14 | 0.25 |
| | 5 | 1 | 0.11 | 0.86 | 10 | 0.06 | 0.05 |
| | 6 | 3 | 0.12 | 1.10 | 11 | 0.20 | 0.18 |

| | | Difference of coefficient of static friction between developing roller and sealing member | | Amount of wear of end portion of developing | Measurement of temperature of end portion of developing | Toner leakage due to insufficient sealing strength of sealing |
|---|---|---|---|---|---|---|
| | | Before use | After use | roller | roller | member |
| Examples | 1 | 0.03 | 0.96 | Excellent | Excellent | Good |
| | 2 | 0.05 | 0.89 | Excellent | Good | Good |
| | 3 | 0.04 | 0.91 | Excellent | Good | Good |
| | 4 | 0.02 | 0.90 | Excellent | Excellent | Good |
| | 5 | 0.05 | 0.83 | Excellent | Excellent | Good |
| | 6 | 0.01 | 0.88 | Excellent | Excellent | Good |
| | 7 | 0.06 | 0.82 | Excellent | Excellent | Good |
| | 8 | 0.03 | 0.87 | Excellent | Good | Good |
| | 9 | 0.02 | 0.91 | Excellent | Excellent | Good |
| | 10 | 0.07 | 0.86 | Excellent | Good | Good |
| | 11 | 0.06 | 1.02 | Good | Good | Good |

TABLE 1-continued

| | | | | | | |
|---|---|---|---|---|---|---|
| Comparative examples | 1 | 0.17 | 0.81 | Good | Poor | Good |
| | 2 | 0.02 | 0.74 | Good | Poor | Good |
| | 3 | 0.09 | 0.69 | Poor | Poor | Poor |
| | 4 | 0.13 | 0.74 | Poor | Poor | Poor |
| | 5 | 0.05 | 0.81 | Excellent | Excellent | Poor |
| | 6 | 0.08 | 0.92 | Poor | Poor | Poor |

What is claimed is:

1. A developing device, comprising:

a developing roller including a base and a surface layer formed on the base, the surface layer including a polyurethane resin having a fluorine group and a polyfunctional isocyanurate structure;

a toner storage chamber being partially in contact with the developing roller and to support the developing roller; and a sealing member provided at opposed ends of an end portion of the toner storage chamber in a rotating axis direction of the developing roller, and to seal in toner moving to the end portion of the toner storage chamber, the sealing member before use having a coefficient of static friction in a range of from 0.08 to 0.19.

2. The developing device of claim 1, wherein the polyurethane resin is a reaction product of hexamethylene diisocyanate isocyanurate and an alternating copolymer of fluoroethylene and vinyl ether.

3. The developing device of claim 1, wherein an outermost surface of the sealing member includes one of a fibrous nap, a film, a felt material, or a base fabric formed of any one of a fluorine resin, polyester, an acrylic resin, ultra high molecular weight polyethylene, polyamide, and polypropylene.

4. The developing device of claim 1, wherein a coefficient of static friction of the developing roller before use is in a range of from 0.11 to 0.13 and a difference between the coefficient of static friction of the developing roller before use and the coefficient of static friction of the sealing member before use is in a range of from 0.01 to 0.07.

5. A process cartridge detachably attachable to an image forming apparatus, comprising:

an electrostatic latent image carrier; and the developing device of claim 1 to develop an electrostatic latent image on the electrostatic latent image carrier, wherein the electrostatic latent image carrier and the developing device are configured as a single unit.

6. An image forming apparatus employing the developing device of claim 1 as a developing mechanism, the image forming apparatus comprising:

an electrostatic latent image carrier to carry an electrostatic latent image;

a charging mechanism to uniformly charge a surface of the electrostatic latent image carrier;

an exposure mechanism to expose the charged surface of the electrostatic latent image carrier based on an image data and write the electrostatic latent image;

the developing mechanism to supply toner to the electrostatic latent image and render the electrostatic latent image visible;

a transfer mechanism to transfer the visible electrostatic latent image on the surface of the electrostatic latent image carrier to a transfer body; and a fixing mechanism to fix the visible electrostatic latent image on the transfer body to the transfer body.

7. An image forming method comprising the steps of:

uniformly charging a surface of an electrostatic latent image carrier;

exposing the charged surface of the electrostatic latent image carrier based on an image data and write an electrostatic latent image;

developing the electrostatic latent image formed on the surface of the electrostatic latent image carrier into a visible image with a developer layer, using the developing device of claim 1;

transferring the visible electrostatic latent image on the surface of the electrostatic latent image carrier to a transfer body; and fixing the visible electrostatic latent image on the transfer body to the transfer body.

* * * * *